United States Patent [19]

Dinning

[11] 4,114,694

[45] Sep. 19, 1978

[54] NO-SHOCK PRESSURE PLUG APPARATUS

[75] Inventor: Robert W. Dinning, Houston, Tex.

[73] Assignee: Brown Oil Tools, Inc., Houston, Tex.

[21] Appl. No.: 797,328

[22] Filed: May 16, 1977

[51] Int. Cl.[2] ..... E21B 23/06

[52] U.S. Cl. ..... 166/318; 137/68 R; 137/625.39; 166/323

[58] Field of Search ..... 166/318, 319, 323; 137/68 R, 625–639; 251/18

[56] References Cited

U.S. PATENT DOCUMENTS

| | | | |
|---|---|---|---|
| 3,090,442 | 5/1963 | Cochran et al. | 166/318 |
| 3,151,681 | 10/1964 | Cochran | 137/625.39 |
| 3,331,378 | 7/1967 | Gibbs et al. | 137/68 R |
| 3,768,556 | 10/1973 | Baker | 166/318 |

*Primary Examiner*—James A. Leppink
*Attorney, Agent, or Firm*—Browing, Bushman & Zamecki

[57] ABSTRACT

Disclosed is releasable plugging apparatus for selectively closing a tubular member to permit fluid pressure buildup therein. When the fluid pressure is then decreased, a sealing device of the apparatus may be released, and the tubular member subsequently opened. Holding apparatus secures the sealing device in place until a compressed spring is permitted to move a piston so as to permit the holding apparatus to release the sealing device. A locking device prevents such movement by the piston until the pressure buildup first moves the piston in the opposite direction to release the locking device and to further compress the spring. The tubular member is thus not unplugged until the fluid pressure is decreased, thereby avoiding a large pressure pulse which might result if the sealing device were released with the fluid pressure at a high value. The embodiments described are particularly applicable for use with hydraulically-operated well tools, such as well packers. The present invention plugs the tubing string supporting the tool to allow hydraulic pressure aplication to operate the tool, and then unplugs the tubing string upon decrease of such hydraulic pressure rather than requiring a further increase of hydraulic pressure to force the plugging apparatus open.

10 Claims, 12 Drawing Figures

Fig. 1
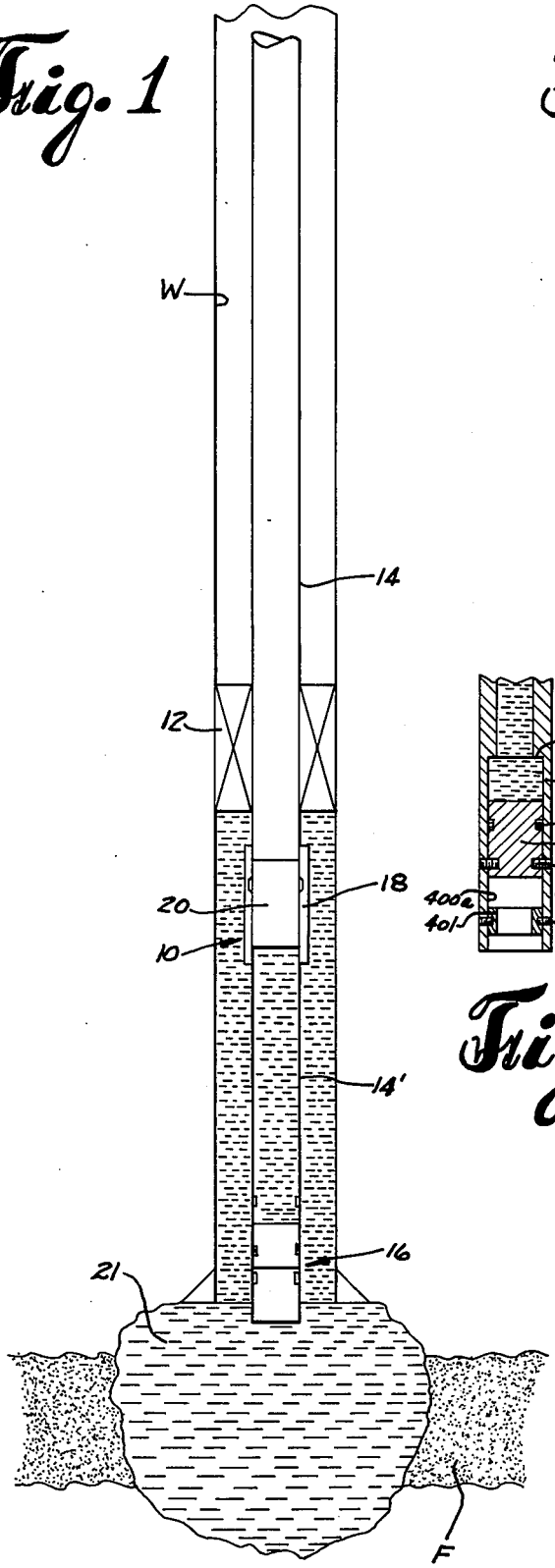
Fig. 2
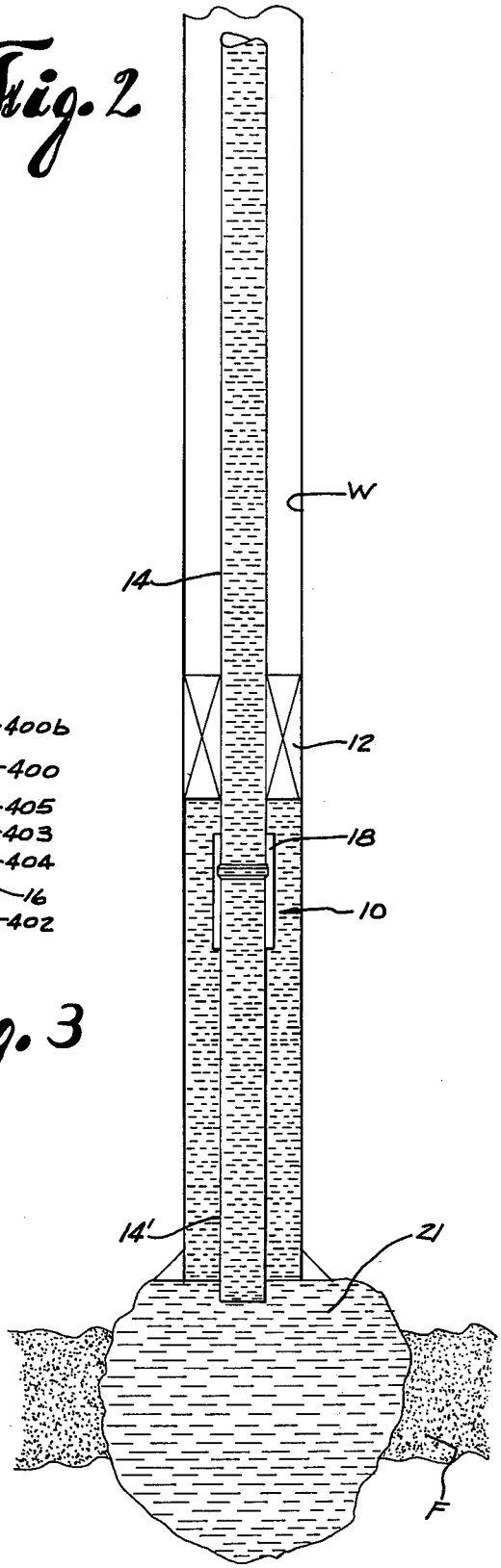
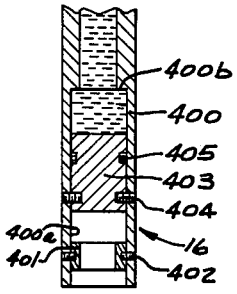
Fig. 3

NO-SHOCK PRESSURE PLUG APPARATUS

BACKGROUND OF THE INVENTION

1. Field of the Invention

The present invention pertains to apparatus for selectively sealing a chamber to permit fluid pressure buildup therein. More particularly, the present invention relates to well tools for selectively plugging tubing strings and hydraulically-operated apparatus, such as well packers, to permit the pressure buildup therein necessary for operating such apparatus, and subsequently opening such tubing strings and apparatus without an attendant high pressure surge.

2. Description of Prior Art

In the completion of wells, packers and other devices are anchored and/or sealed to the well casing. Various techniques are used to set, or otherwise operate, such tools, including mechanical or hydraulic actuation techniques. In the latter case, a tool, such as a packer, is lowered into place in the well, and a hydraulic-pressure communicating conduit, leading to the well surface, is established. Then, a hydraulic pressure increase may be effected at the tool by pumping on the fluid in the conduit at the well surface. As the pressure at the tool increases, components of the tool respond to carry out the desired operation, such as the setting of a packer in the well casing. Once such operation is completed, the pressure-communicating conduit may be opened, and further well working processes carried out.

It is a common practice to lower such pressure-actuated tools into position within the well by suspending such a tool from a tubing string extended down the well from the surface. In some instances, the tubing string may be utilized in place after the tool is set, or otherwise actuated. As an alternative, the tubing string may be withdrawn, or replaced with, say, a production string. In any event, the tubing string may serve as a pressure-communicating conduit to actuate the tool. In such case, the tubing string, or an extension thereof, must be sealed closed at or below the position of the tool to be actuated. In many cases, though, the seal must be opened or released after the tool is actuated for continued operations within the well.

To carry out such an operation, an open tubing string, supporting the tool to be placed within the well, is lowered into position within the well. A ball or other sealing device is then dropped down the tubing string and caught on a seat at the bottom of the tool, or in an extension of the tool or tubing string below the tool. Fluid is then pumped into the tubing string at the well surface, thereby building up pressure in the tubing string and in the tool. Appropriate components within the tool move in response to such pressure effecting the setting of the tool or other operation to be carried out.

To open the tool and tubing string again, a common practice includes increasing the fluid pressure within the tubing string beyond that which is required to actuate the tool. Then, a shear pin or similar device is broken to free the seat holding the ball or other plug device. Once this occurs, the ball and seat are free to drop down the well, thereby opening the tool and tubing string as desired.

It will be appreciated that the sudden release of the plug and seat upon the breaking of the shear pin, or such device, in response to the high pressure established within the tubing string is accompanied by a high pressure pulse transmitted down the tubing string beyond the original position of the plug, and into the well and formation below. The shock of such a pulse may be sufficiently great to disturb the underground formation, as well to impart a sharp kick, or vibration, to the tubing string. In the latter case, the tubing string as well as any attached tools, including the just-actuated tool for which the hydraulic pressure buildup was initially introduced, may be dislodged or even damaged. Where the formation itself is disrupted, a decrease in production may result. Aside from these destructive effects which may be caused by such a large pressure shock, the buildup of pressure within the pressure-actuated tool above the pressure value needed to so actuate the tool may itself disrupt the setting of the tool, or even cause damage thereto.

Attempts have been made to solve this problem whereby the pressure within the tubing string may be reduced prior to the release of the seal and seat mechanism. However, these attempts generally require complete equalization of pressure across the seal prior to the release of the seal and seat. Such a complete equalization is impossible where the static fluid pressure head in the tubing string itself is greater than the down hole formation pressure.

U.S. Pat. No. 3,331,378 discloses a plugging device which is placed in a condition to be released after the hyraulic pressure within the tubing string is sufficiently raised to carry out the desired tool setting or other operation. Then, the valve seat holding the ball valve closure remains in plugging configuration as long as the pressure within the tubing string is sufficiently great to press the seat against a locking ring with sufficient force to prevent the locking ring, by friction, from expanding to release the seat. When the tubing string pressure is sufficiently decreased, the reduced frictional force is overcome, and the locking ring expands, thereby releasing the seat and ball valve to open the tubing string.

U.S. Pat. No. 3,090,442 utilizes frictional forces to effect anchoring of a plugging mechanism by a plurality of dogs as the tool-actuating hydraulic pressure is built up. Then, the pressure is sufficiently reduced to lower the frictional forces to a point where they can be overcome by expansion of a compressed spring moving a sleeve to release the anchoring bind of the dogs on the plugging mechanism.

SUMMARY OF THE INVENTION

The plugging apparatus of the present invention features a valve member such as a plug, or sealing device, for releasably closing off a tubular member, or conduit. The plug may be held in sealing configuration by anchoring apparatus. When the anchoring apparatus is moved to a release configuration, the plug is free to be moved out of its sealing configuration. Restraining apparatus maintains the anchoring apparatus in an anchoring engagement with the sealing device, and only the removal of the restraining apparatus from the anchoring apparatus permits the latter to be moved into the aforementioned release configuration. The restraining apparatus may be so removed from the anchoring apparatus by a moving piston acting on the restraining apparatus.

The piston is initially prevented from such movement by a locking device, preferably in the form of a shear pin. When the hydraulic pressure is increased within the tubular member as desired, the piston receives the fluid pressure communicated from the tubular member, and is moved thereby in a first direction, compressing a spring or other restorative apparatus. This pressure-responsive movement by the piston causes the locking device to release, that is, the shear pin is thus broken. The large hydraulic pressure acting on the piston then prevents the piston from moving against the restraining means. The stored energy in the compressed spring is released as the hydraulic pressure within the tubular member and, therefore, acting on the piston, is decreased, whereby the compressed spring drives the piston back in a second direction opposite to the first direction, whereupon the piston interacts with the restraining means.

It will be appreciated that the instantaneous displacement of the piston in the second direction, motivated by the compressed spring, is dependent on the instantaneous value of the hydraulic pressure acting on the piston in opposition to such displacement. With the hydraulic pressure sufficiently reduced, the piston interacts with the restraining apparatus to cause the anchoring apparatus to be permitted to move to the release configuration. The plug device may then be readily removed from its sealing configuration, thereby opening the tubular member.

When used in conjunction with a tubing string and a hydraulically-actuated, down hole well tool suspended therefrom, the plugging apparatus of the present invention may form an extension of such tool, or be suspended by a continuation of the tubing string below the tool. The plug device may then be a ball, or other valve device, in sealing engagement with a seat. This type of sealing device allows the tubing string and well tool to remain open to fluid communication therethrough as they are being run in the well, and permits the ball to be dropped in place on the seat to selectively plug the tubing string and tool when the latter is in position in the well.

The seat may be anchored in the plugging apparatus by dogs, arranged to move radially outwardly to release the seat. A restraining ring prevents the dogs from so moving radially until the restraining ring is moved longitudinally out of position by an annular piston moving under the influence of a compressed spring. An alternative anchoring mechanism includes lugs protruding radially inwardly from collet fingers. The restraining is effected by the collet fingers, whose shape and resiliency hold the lugs in anchoring engagement with the seat member until the moving piston wedges the collet fingers radially outwardly.

The increase in hydraulic pressure within the tubing string is communicated to the annular piston through spacing in a mandrel assembly to which the seat member is sealed when held in place by the dogs, or lug-equipped collet fingers. A shear pin prevents the piston from moving until the increased hydraulic pressure forces the piston in a longitudinal direction away from the anchoring apparatus. Such movement by the piston compresses the spring which, as the hydraulic pressure is decreased, moves the piston in the opposite direction to effect release of the anchoring mechanism from the seat member.

An alternative form of plug device includes a solid, generally cylindrical plug, held in place by a plurality of dogs suspended by resilient collet fingers, with appropriate sealing effected between the cylindrical plug and a surrounding mandrel generally constituting an extension of the tubing string. A restraining ring prevents the dogs from moving radially outwardly to release the plugging cylinder until a spring-propelled annular piston removes the restraining ring, as described hereinbefore.

The present invention thus provides a mechanism for releasably plugging a tubular member, such as a well tubing string and associated tool or tools, permitting the increase of fluid pressure within said tubular member, and unplugging, or opening, such tubular member only when the fluid pressure therein has been reduced to such a low value that high pressure pulses that might otherwise be generated upon the unplugging of the tubular member are avoided. Advantages of the present invention over prior art apparatus include the lack of any requirement that the fluid pressure must first be equalized across the plug device before the tubular member is opened. Furthermore, unlike the aforementioned prior art patents, there is no absolute reliance upon pressure-induced frictional forces to maintain the anchoring apparatus of the present invention in anchoring engagement with the plugging device.

It will be appreciated that, while the particular embodiments described hereinafter are applicable to use with well equipment responsive to hydraulic pressure, the scope of the invention includes the construction of the apparatus of the invention to be responsive to fluid pressure in general, where the term "fluid" encompasses not only liquids but gases as well.

BRIEF DESCRIPTION OF THE DRAWINGS

FIG. 1 is a schematic illustration of the plugging apparatus of the present invention employed in conjuction with a well packer and tubing string positioned within a well, which is shown in longitudinal cross-section;

FIG. 2 is an illustration similar to FIG. 1, showing the tubing string unplugged for production of the well;

FIG. 3 is an enlarged, schematic view, in cross-section, of a floating seal plug used with the equipment of FIG. 1;

DESCRIPTION OF PREFERRED EMBODIMENTS

Figure 4:
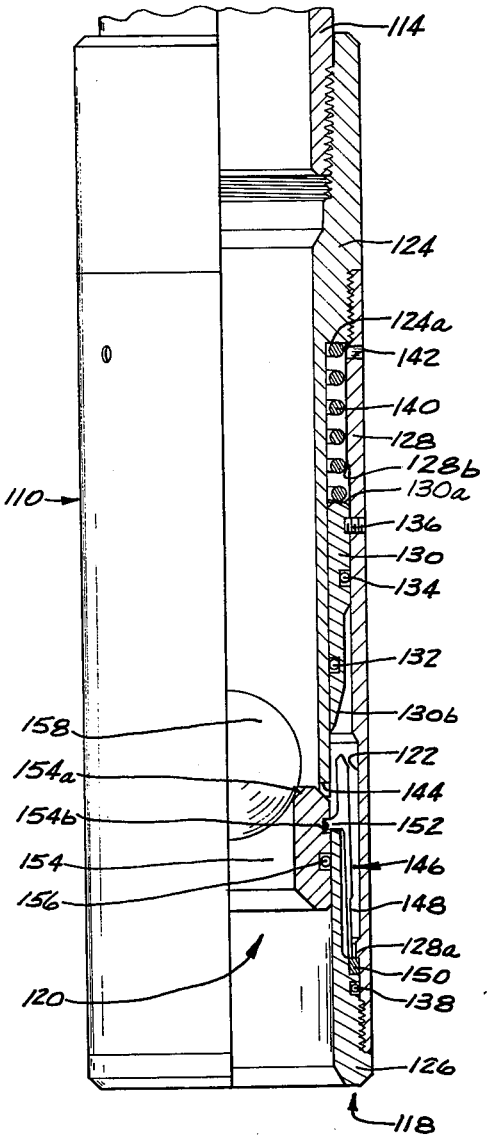
FIG. 4 is a quarter-sectional view of one embodiment of the plugging apparatus of the present invention, featuring a ball and seat held in place by lug-equipped collet fingers.

The no-shock pressure plug of the present invention is illustrated generally at 10 in FIGS. 1 and 2, positioned below a well packer 12 within a well. Both the packer 12 and the plugging apparatus at 10 are suspended from a tubing string 14, and form successive extensions thereof. A continuation of the tubing string 14' extends below the plugging apparatus 10. A floating seal plug is shown at 16 in FIGS. 1 and 3, and is discussed in more detail hereinafter.

As is shown schematically in FIGS. 1 and 2, the pressure plug apparatus at 10 may be considered as including at least two major components: a generally tubular housing, or mandrel assembly, 18; and a plug or sealing device 20. With the sealing device 20 appropriately anchored within the housing 18, the pressure plug apparatus at 10 seals the tubular member 14 below the packer 12. Hydraulic pressure may be increased within the tubing string 14 and well packer 12 by pumping at the well surface (not shown). The appropriately designed well packer 12 is then set in response to the increased hydraulic pressure, that is, the packer 12 is sealed to the interior surface of the well W, and may also be anchored thereto. Thus, by appropriate attachment of the tubing string 14 to the set packer 12, the tubing string is also sealed to the wall of the well W. To facilitate such a sealing to the well wall, the well W may be lined with casing in a well known manner.

With the packer 12 thus set, hydraulic pressure within the tubing string 14 and packer may be reduced by bleeding the tubing string 14 at the surface, or by any other appropriate method. Once the pressure within the tubing string 14 is sufficiently lowered, the sealing device 20 is released from anchoring engagement with the housing 18, and may be dropped, or pumped, down the tubing string extension 14', thereby clearing the tubing string as shown in FIG. 2 for production of well fluid to the surface.

The well W is shown extending to the vicinity of an underground formation F, from whence well fluids 21 flow for conduction up the tubing string 14 as indicated in FIG. 2. It will be appreciated that the tubing string 14 on which the packer 12 and pressure plug apparatus at 10 are positioned within the well W, and by which the hydraulic pressure to set the packer 12 is communicated, may be replaced with a more appropriate tubing string for production purposes. In such case, the tubing string 14 may be withdrawn from the well with the packer 12 in place after the sealing device 20 has been released. Then, an appropriate production string may be positioned in the well in place of the tubing string 14 in FIG. 2, and lead to appropriate surface equipment, including blowout preventors and necessary connections for production.

Figure 5:
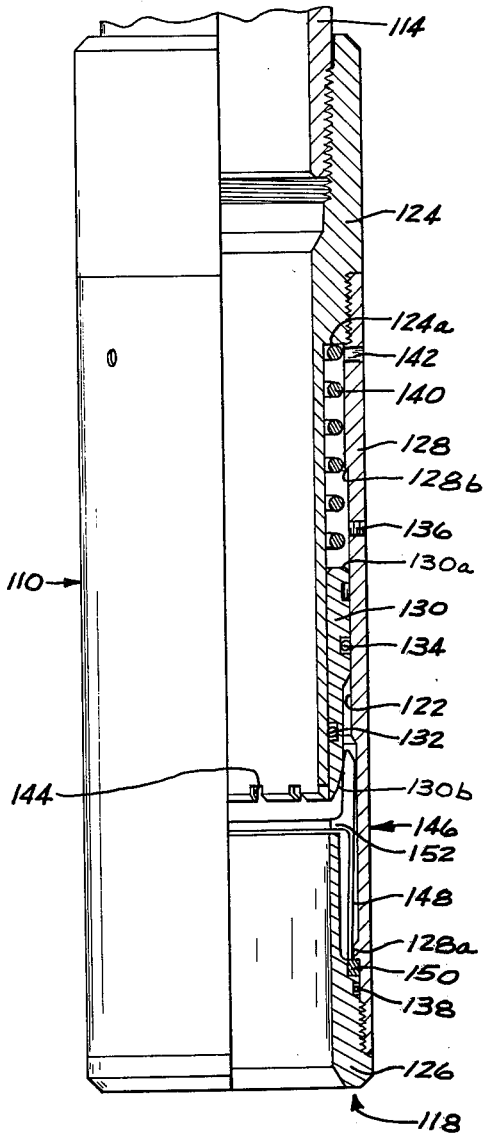
FIG. 5 is an illustration similar to FIG. 4, with the ball and seat released.

A plugging apparatus of the present invention is shown in detail in FIGS. 4 and 5 at 110. In this and succeeding embodiments discussed hereinafter, like elements are similarly numbered, with number values for such elements differing by one hundred or two hundred among the different embodiments. The pressure plug apparatus 110 is shown suspended from a tubular element 114. It will be appreciated that the tubular element 114 may be a tubing string, or the extension of a tubing string below a well tool positioned above the pressure plug apparatus at 110, or may even be the lower portion of the well tool itself.

A housing and sealing device are shown in detail at 118 and 120, respectively. The housing 118 includes an annular pressure chamber 122 formed by the cooperation of an upper mandrel 124, a base mandrel 126, and a sleeve 128. The sleeve 128 is threadedly joined to both the upper and base mandrels, 124 and 126, respectively, which extend longitudinally within the sleeve and are radially spaced therefrom to establish the pressure chamber 122. The upper mandrel 124 further extends upwardly to threadedly join the tubular member 114. It will be appreciated that the base mandrel 126 may also be constructed to provide for threaded attachment to a tubular member (not shown) for extension below the plugging apparatus 110.

An annular sleeve piston 130 is positioned within the pressure chamber 122, and fluid-sealed to the upper mandrel 124 and the sleeve 128 by sliding-seal O-rings 132 and 134, respectively. A frangible shear pin 136 locks the piston 130 against movement relative to the sleeve 128. An O-ring seal 138 fluid-seals the base mandrel defining, with the O-rings 132 and 134, the longitudinal limits of the fluid-pressure receiving region of the pressure chamber 122.

To the opposite longitudinal side of the piston 130 from the pressure-receiving area of the pressure chamber 122 is located a coil spring 140, confined and compressed by a shoulder 124*a* of the upper mandrel 124, and the top of the piston 130*a*. A plurality of ports 142 extends through the sleeve 128 to the exterior of the housing 118, thereby permitting fluid communication between said exterior and the spring-holding region between the sleeve and the upper mandrel 124, and, therefore, the top of the piston 130*a*.

The bottom edge of the upper mandrel 124 is equipped with a plurality of upwardly extending recesses 144 which communicate fluid pressure from within the upper mandrel and, therefore, the tubular member 114 to the pressure chamber 122 when the sealing device at 120 is anchored in place as indicated in FIG. 4.

A collet assembly at 146 features a plurality of upwardly extending collet fingers 148 depending from a base ring 150, which is held in place between the base mandrel 126 and the sleeve 128. An inwardly-extending shoulder 128*a* secures the base ring 150 in position. Each collet finger 148 is equipped with a laterally-directed lug 152. The collet fingers 148 are generally resilient, and constructed to urge the lugs 152 radially inwardly to extend through the spacing defined by the top of the base mandrel 126 and the bottom of the upper mandrel 124, and, therefore, to the interior of the housing at 118.

The bottom of the piston 130 features a downwardly and inwardly slanting beveled surface 130*b*. Each collet finger 148 extends upwardly beyond its respective lug 152 so that, when the piston 130 is lowered sufficiently relative to the collet assembly at 146, the beveled surface 130*b* passes to the radially inward side of the top of each collet finger, wedging the latter radially outwardly, as discussed in more detail hereinafter.

The sealing device at 120 includes an annular seat member 154, illustrated in FIG. 4 as fluid-sealed to the interior surface of the base mandrel 126 by an O-ring 156. A ball valve 158 is shown in sealing configuration in place on an annular seating surface 154*a*. The seat member 154 is equipped with an annular groove 154*b* circumscribing the radially outer surface of the seat member. The groove 154*b* receives the lugs 152 when the collet fingers 148 are free to urge the lugs radially inwardly, as indicated in FIG. 4. Thus, the lugs 152 cooperate with the groove 154*b* to anchor the seat member 154 to the housing 118, and the collet fingers act to restrain the lugs from moving out of the groove 154*b*. With the ball valve 158 in place as indicated in FIG. 4, the entire sealing device 120 is thus anchored to the housing at 118 in sealing configuration.

The plugging apparatus 110, suspended from the tubular member 114, is lowered into the well W until the associated packer 12, or other tool, is in position as indicated in FIG. 1. This running-in process may be effected with the ball valve 158 deleted from the plugging apparatus 110. Then, with the associated packer in place for setting, or other operation, the ball valve 158 may be dropped, or pumped, down the tubing string to be caught on the seat 154*a* of the seat member 154. With the ball valve 158 thus in sealing position as indicated in FIG. 4, hydraulic pressure may be applied to the interior of the plugging apparatus 110 as well as the tubing string and associated tools to be operated positioned thereabove. This hydraulic pressure may be effected by pumping at the surface.

As the pressure above the ball valve 158 increases, such increased pressure is communicated to the pressure chamber 122 through the recesses 144. Resulting force acting on the lower surface of the piston 130*b* causes the latter to be urged upwardly, shearing the pin 136. Continued increase in pressure within the chamber 122 drives the piston 130 upwardly, further compressing the spring 140. Fluid movement through the ports 142 prevents a pressure lock which might interfere with such movement by the piston 130. The longitudinal displacement of the piston will be determined, in part, by the increased hydraulic pressure received within the chamber 122 as opposed by the down-hole fluid pressure communicated through the ports 142 in combination with the restorative forces generated by the compressed spring 140. An inwardly-extending shoulder 128*a* on the sleeve 128 limits the upward movement of the piston 130.

With the packer set, or other tool appropriately operated, in response to the increased hydraulic pressure above the seated ball valve 158, the hydraulic pressure within the tubing string supporting the plugging apparatus 110 may be reduced by bleeding at the surface, or other appropriate method. As the hydraulic pressure within the chamber 122 is thus descreased, the aforementioned forces acting on the piston 130 will move the latter element downwardly, always striving to maintain the forces acting on the piston in balance. Again, the fluid communication afforded by the ports 142 prevents a pressure, or vacuum, lock which might interfere with the downward movement of the piston 130. As the hydraulic pressure within the chamber 122 continually reduces, the piston 130 is driven sufficiently downwardly that the beveled annular surface 130*b* moves between the collet fingers 148 and the lower extension of the upper mandrel 124. Thus, the beveled surface 130*b* wedges the collet fingers 148 radially outwardly, causing the lugs 152 to be withdrawn from the annular groove 154*b*. With the annular seat member 154 thus freed from anchoring engagement by the lugs 152, the sealing device 120, including the annular seat member and the ball valve 158, may drop downwardly through the mandrel assembly 118, and any lower extension of the tubing string.

Thus, by reducing the hydraulic pressure within the tubing string after the frangible pin 136 has been sheared, the tubing string and any associated tool operated on by the increased hydraulic pressure are unplugged by the freeing of the sealing device 120. It will be appreicated that the size and force constant of the spring 140 determines, in part, the value of the hydraulic pressure within the tubing string at which the sealing device 120 is released. Thus, for example, the spring 140 may be appropriately selected to release the sealing device 120 when the hydraulic pressure within the tubing string at the level of the pressure chamber 122 has been reduced to within any specific number of pounds per square inch relative to the down-hole pressure communicated through the ports 142. Therefore, the tubing string is able to be unplugged with the release of the sealing device 120 when the hydraulic pressure within the tubing string has been reduced to such a value that no appreciable pressure differential exists across the sealing device to generate a disturbing shock wave by the unplugging operation.

Another embodiment of the no-shock pressure plug of the present invention is shown at 210 in FIGS. 6–10. The plugging apparatus 210, shown suspended from a tubular member 214 by threaded connection, includes a housing, or mandrel assembly, shown generally at 218 and a sealing, or plug, device at 220. The bottom end of the housing 218 is threaded for supporting a continuation of the tubing string, or an additional well tool. A pressure chamber 222 is limited by an upper mandrel 224 and a base mandrel 226. A sleeve 228 is threadedly joined to each of the mandrels 224 and 226 to mutually anchor the latter two elements. A generally annular piston is fluid-sealed to the upper and base mandrels 224 and 226 by sliding-seal O-rings 232 and 234, respectively. The piston 230 thus cooperates with the extensions of the mandrels 224 and 226 within the sleeve 228 to complete the definition of the pressure chamber 222. A frangible shear pin 236 locks the piston 230 against movement relative to the base mandrel 226.

Above the piston 230 is located a coil spring of rectangular wire 240, confined and compressed by a shoulder 224*a* of the upper mandrel 224, and by the top of the piston 230. Thus, as the piston 230 is urged upwardly against the spring 240, the latter element is further compressed.

While the piston 230 is fluid-sealed to the upper and base mandrels, 224 and 226, respectively, as noted hereinbefore, the interior surface of the sleeve 228 is displaced radially outwardly from the piston. Thus, fluid is generally free to communicate along the region between the piston 230 and the sleeve 228. A plurality of upper ports 242 and lower ports 243 permit fluid communication between the region exterior to the housing 218 and the regions between the sleeve 228 and the extensions of the mandrels 224 and 226, as well as the piston 230. Thus, as the piston 230 is moved longitudinally relative to the sleeve 228, as described hereinafter, down-hole well fluid is generally free to move through the ports 242 and 243 to the end that fluid pressure blocks, which might inhibit the movement of the piston, are avoided. Furthermore, it will be appreciated from FIGS. 6, 8, and 9 that the area of the upper piston surface 230*a*, exposed to such down-hole fluid pressure, is greater than the corresponding area of the lower piston surface 230*b*. Thus, down-hole fluid pressure applied to the piston 230 generally urges that element downwardly relative to the mandrel assembly 218.

Figure 9:
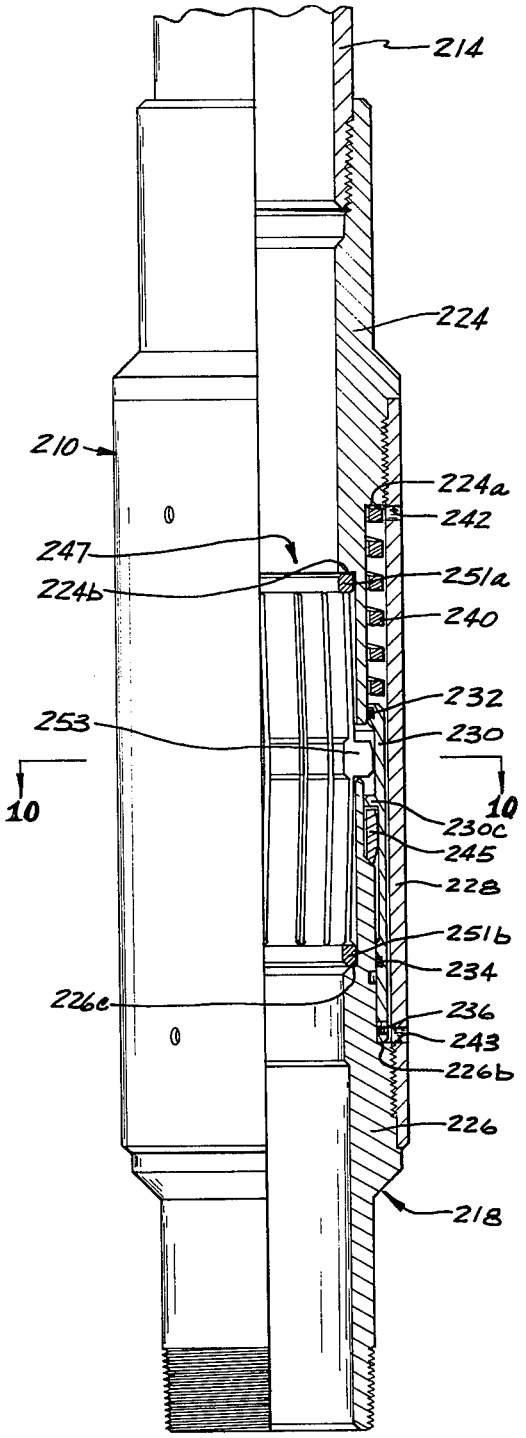
FIG. 9 is an illustration similar to FIGS. 6 and 8, with the cylindrical plug released.
Figure 7:
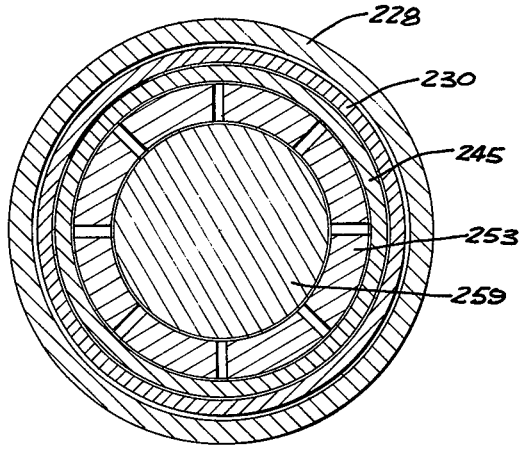
FIG. 7 is a horizontal cross-section of the apparatus as shown in FIG. 6, taken along the line 7—7.
Figure 10:
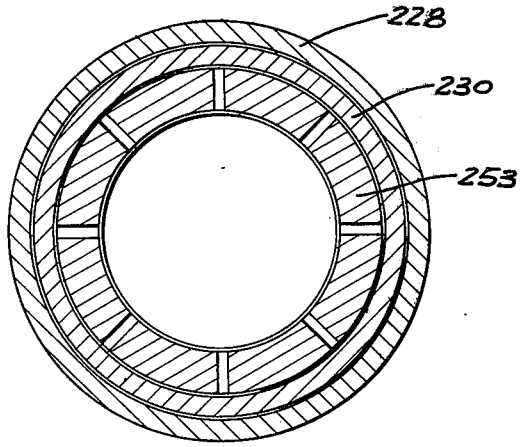
FIG. 10 is a horizontal cross-section of the apparatus as illustrated in FIG. 9 taken along the line 10—10.

Fluid pressure from within the tubular member 214 may be communicated to the pressure chamber 222 through the annular opening existing between the lower and upper ends of the upper mandrel 224 and the base mandrel 226, respectively. The piston 230 features an inwardly-extending annular lip 230*c* which fits over a restraining ring 245, and, as the piston is moved downwardly, forces the ring 245 to move downwardly also. A beveled shoulder 226*a* on the base mandrel 226 receives the beveled lower surface 245*a* of the restraining ring to constitute a lower limit for motion of the restraining ring 245, as indicated in FIG. 9. Also, a radially outwardly-extending shoulder 226*b* of the base mandrel 226 forms the lower limit for motion of the piston 230.

A collet assembly at 247 includes a plurality of longitudinally extending collet fingers 249 depending from upper and lower base rings 251*a* and 251*b*, respectively. The collet assembly 247 is held within the mandrel assembly 218 by the base rings 251*a* and 251*b* being stopped by inwardly-directed annular shoulders 224*b* and 226*c* of the upper and base mandrels 224 and 226, respectively.

At generally the same longitudinal position along each of the collet fingers 249 is located a dog 253. The collet fingers 249 exhibit sufficient resiliency that the dogs 253 are relatively free to be moved radially inwardly and outwardly when otherwise not confined.

Figure 6:
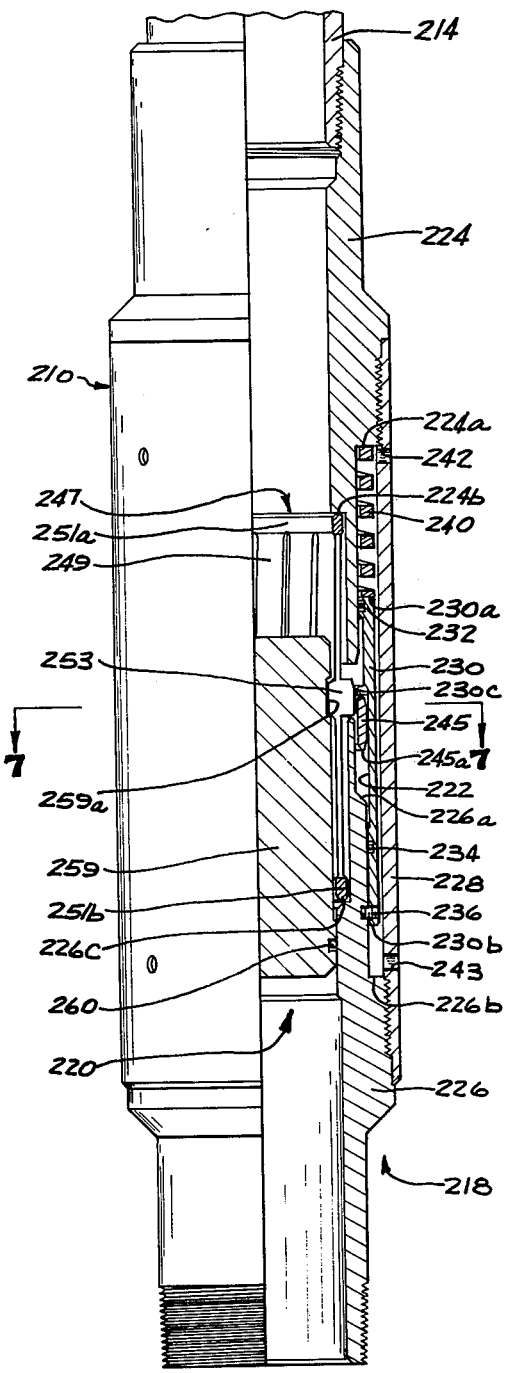
FIG. 6 is a quarter-sectional view of another embodiment of the present invention, featuring a generally cylindrical plug device anchored by collet-supported dogs.
Figure 8:
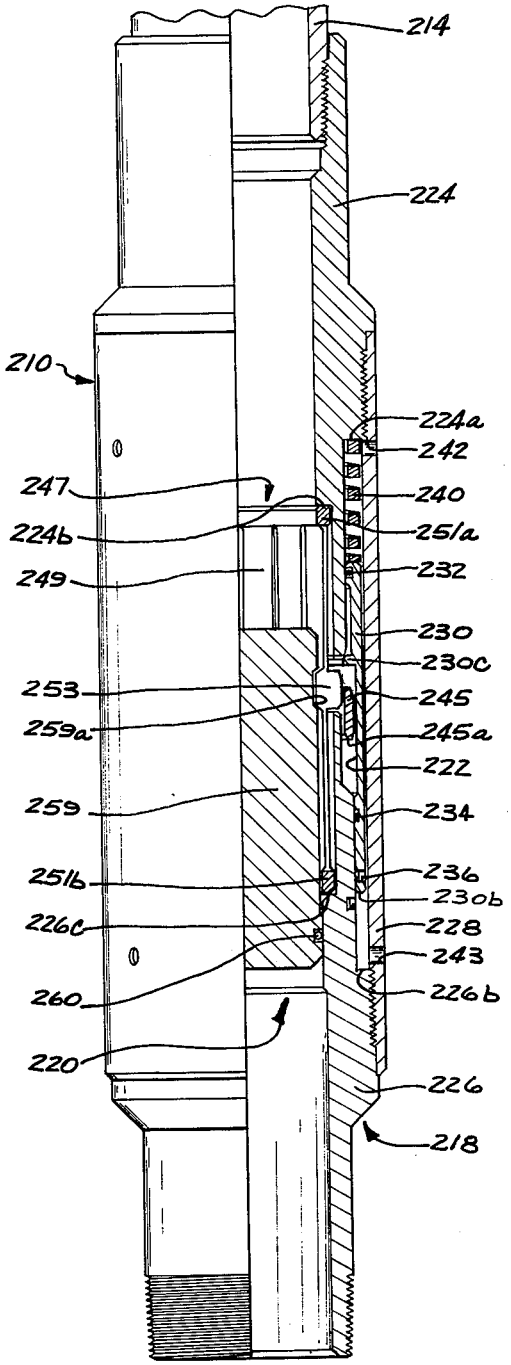
FIG. 8 is a view similar to FIG. 6, showing the piston of the plugging apparatus advanced by increased hydraulic pressure to compress the spring.

The sealing device at 220 includes a generally cylindrical plug element 259 which carries, in an appropriate annular groove, an O-ring seal 260 which fluid-seals the plug element to the interior surface of the base mandrel 226, acting as an annular seat, when the plug element is in sealing configuration as indicated in FIG. 6. The transverse dimension of the solid plug element 259, at the location of the O-ring and its related annular groove, is sufficiently large to just negotiate the interior dimension of the base mandrel 226 to insure a proper fluid-sealing by way of the O-ring 260. The remainder of the plug element 259 is of generally slightly reduced transverse dimension to enable the plug element to move past the lower base ring 251*b* of the collet assembly 247, as discussed in more detail hereinafter.

The plug element 259 also features, on its radially outer surface, an extended annular groove 259*a* with beveled side walls. The groove 259*a* receives the dogs 253 when the plug element 259 is in the sealing configuration indicated in FIG. 6. Then, with the restraining ring 245 positioned between the piston 230 and the dogs 253 as shown in FIG. 6, the dogs are held by the restraining ring from moving radially out of the groove 259*a*. Thus, the dogs 253 anchor the plug element 259 from longitudinal movement relative to the mandrel member 218, and maintain the plug element in sealing configuration.

The plug element 259 may be inserted within the housing 218 to achieve the sealing configuration shown in FIG. 6 as the housing is being assembled. With the restraining ring 245 lowered on the base mandrel 226, the plug element 259 is positioned, with the dogs 253 fitted in the groove 259*a*, within the base mandrel. The ring 245 is then raised to confine the dogs 253. The piston 230 is positioned and locked in place by the sheaar pin 236, as shown. The sleeve 228, the spring 240 and the upper mandrel 224 are then added.

The no-shock plug embodiment illustrated in FIGS. 6–10 may be inserted in a well in combination with a packer or other tool to be operated by hydraulic pressure as generally indicated in FIG. 1. In this instance, the plug element 259 is in sealing configuration as shown in FIG. 6. To accommodate the passage of the tubing string, tool to be operated, and the plugging apparatus 210 through well fluids as the combination is lowered into the well, a sleeve valve (not shown) may be employed along the tubing string at some position above that of the plugging apparatus. Such sleeve valves, for example like that disclosed in U.S. Pat. No. 3,151,681, are well known in the field, and will not be described in detail herein. The sleeve valve is in open configuration as the tubing string and attached elements are lowered into the well to permit well fluids to enter the tubing string above the plugging apparatus 210 to diminish, or eliminate, any buoyancy or pressure locks which might result otherwise. Once the tubing string with attached apparatus is positioned as intended in the well, the sleeve valve is closed to cooperate with the plugging apparatus 210 to fluid-seal the interior of the tubing string and related apparatus from the exterior down-hole fluids.

An alternative method for lowering a tubing string assembly employing the plugging apparatus 210 involves pumping fluid from the surface into the tubing string above the plugging apparatus as the tubing string is lowered into the well.

With the plugging apparatus 210 in the configuration shown in FIG. 6, the plug element 259 seals the interior of the tubing string at the O-ring seal 260, and the plug element is anchored relative to the mandrel assembly 218 by the dogs 253. To operate the well packer or other tool to be operated by hydraulic pressure, the pressure within the tubing string is increased by pumping at the surface, or other appropriate means. The increased hydraulic pressure within the mandrel assembly 218 is communicated through the opening between the upper and base mandrels 224 and 226, respectively, to the pressure chamber 222, as discussed hereinbefore.

The diameter of the outer surface of the extension of the upper mandrel 224 engaging the O-ring 232 carried by the piston 230 is smaller than the diameter of the outer surface of the upward extension of the base mandrel 226 engaging the O-ring 234 also carried by the piston 230. These two O-ring seals define the longitudinal limits of the pressure chamber 222 exposed to the increased hydraulic pressure from within the tubing string. Thus, the hydraulic pressure acting within the chamber 222 generates a net force on the piston 230 urging that element upwardly relative to the mandrel assembly 218.

Such upward movement by the piston 230 causes the coil spring 240 to be further compressed, and also moves the shoulder 230*c* away from alignment with the dogs 253 and toward the bottom edge of the upper mandrel 224. Contact of the shoulder 230*c* with that bottom edge of the upper mandrel 224 limits the upward movement of the piston 230. As the piston 230 moves upwardly, frictional forces acting between the dogs 253 and the restraining ring 245 maintain the ring aligned with the plurality of dogs 253 to keep the latter elements locked in anchoring engagement with the plug element 259 by their insertion within the groove 259*a*.

As the hydraulic pressure within the tubing string and, therefore, within the pressure chamber 222 is reduced after the setting, or other operation, of the well tool on the tubing string above the plugging apparatus 210, the force exerted on the piston 230 by the compressed spring 240 is able to move the piston downwardly relative to the dogs 253. Also, as noted hereinbefore, the down-hole fluid pressure communicated through the ports 242 and 243 acts on the unequal end surfaces 230*a* and 230*b* of the piston 230 to cause a net downward force added to that of the compressed spring 240 to drive the piston downwardly. As the piston 230 thus is driven downwardly, the shoulder 230*c* engages the restraining ring 245 to pull the latter element down and out of transverse alignment with the dogs 253. As the restraining ring 245 and the shoulder 230c are moved beyond the dogs 253, the resiliency of the collet fingers 249 permit the dogs to move sufficiently radially outwardly to free the plug element 259 from anchoring engagement therewith. Such action by the dogs 253 may occur under the influence of the weight of the plug element 259 forcing the dogs up the beveled side wall of the groove 259a, or by pumping fluid down the well to force the plug element clear of the dogs.

As in the previously-described embodiment shown in FIGS. 4 and 5, the size and force constant of the spring 240 may be adjusted to insure that the plug element 259 is not released until the hydraulic pressure within the tubing string has been reduced to any desired value relative to the down-hole fluid pressure exterior of the housing 218. Thus, the no-shock pressure plug shown in FIGS. 6–10 may be adjusted and used to unseal the tubing string, after the setting of a well packer, or other tool operation, by increased hydraulic pressure, when the pressure within the tubing string has been reduced to such a value that no pressure differential across the plug remains of value sufficient to generate a damaging pressure wave upon such unsealing.

Figure 11:
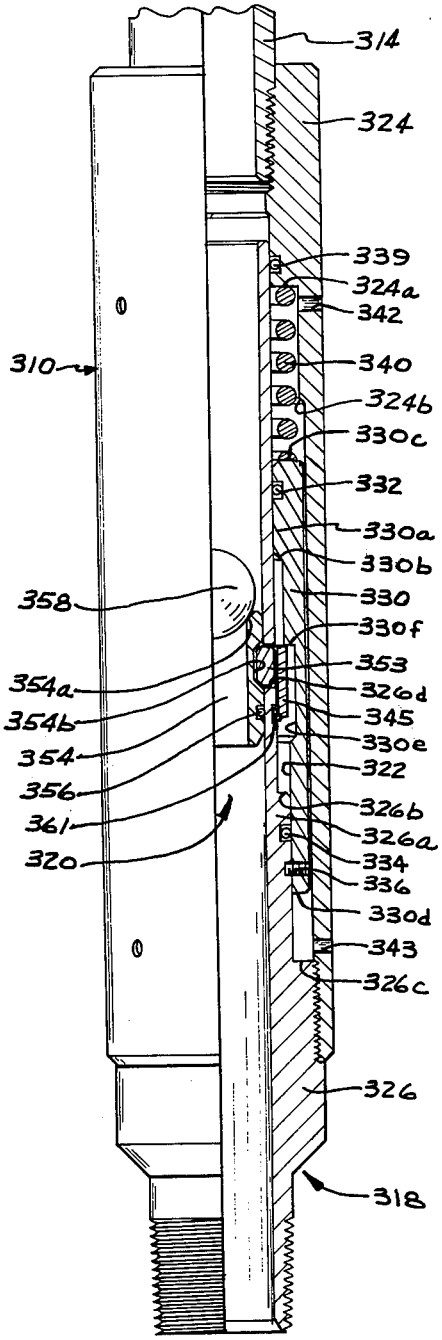
FIG. 11 is a quarter-sectional view of another embodiment of the present invention, featuring a dog-anchored seat and ball plug device.
Figure 12:
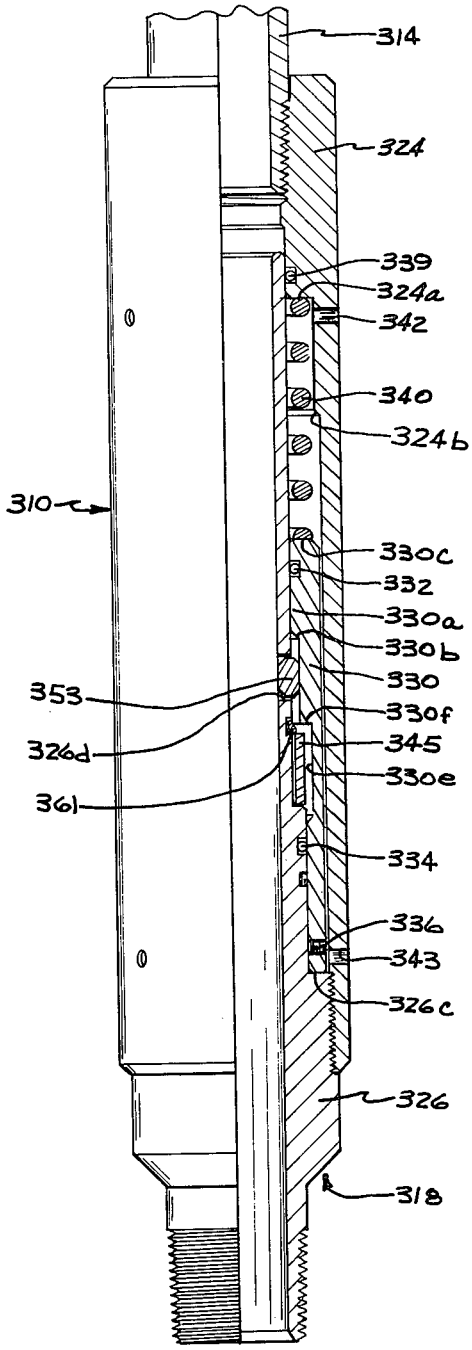
FIG. 12 is an illustration similar to FIG. 11, with the ball and seat released.

FIGS. 11 and 12 illustrate still another embodiment of the no-shock pressure plug of the present invention at 310. As in the previously described embodiments, the plugging apparatus 310 may be suspended, by threaded connection, from a tubular element 314 which may be a continuation of a tubing string, or may be the lower end of a well tool to be operated within the well. The plugging apparatus 310 generally includes a plug, or sealing, device shown at 320 which may be anchored and sealingly engaged to a mandrel assembly, or housing, shown at 318. The bottom end of the mandrel assembly is threaded for supporting a continuation of the tubing string by which the plugging apparatus 310 is suspended within the well, or for supporting an additional well tool. The housing 318 includes a generally annular pressure chamber 322 enclosed within the generally annular region defined within the lower extension of an upper mandrel 324 and external to the upward extension of a base mandrel 326. Between the two aforementioned mandrel extensions, a generally annular piston 330 cooperates with the upward extension of the base mandrel 326 to define the limits of the pressure chamber 322.

The piston 330 includes an upper, radially inwardly extending annular projection 330a carrying, in an appropriate annular groove, an O-ring seal 332, and thereby sealingly engaging the upward extension of the base mandrel 326. An intermediate section of the base mandrel 326a exhibits a larger transverse dimension than the region engaged by the O-ring 332. The segment 326a includes, in an appropriate groove, an O-ring seal 334 which fluid-seals the segment 326a to the piston 330. An annular shoulder 326b marks the point of variation in transverse dimension of the upward extension of the base mandrel 326, and serves as a stop in a manner described hereinafter. A second annular shoulder 326a similarly defines a change in transverse dimension of the base mandrel 326 at the position where the base mandrel is threadedly joined to upper mandrel 324. An inwardly extending annular shoulder 330b similarly marks the variation of internal transverse dimension of the piston 330 adjacent the projection 330a.

A frangible shear pin 336 holds the piston 330 locked against movement relative to the base mandrel 326. It will be appreciated that, due to the differences in lateral dimensions of the piston 330 and the base mandrel 326 in the regions of sealing by the O-rings 332 and 334, hydraulic pressure received within the pressure chamber 322 will produce a net force of the piston urging that element upwardly relative to the housing 318. An O-ring 339 seals the inner surface of the upper mandrel 324 to the upward extension of the base mandrel 326.

A coil spring 340 is confined and compressed between an inwardly extending annular shoulder 324a of the upper mandrel 324 and the top surface 330c of the piston 330. A plurality of upper and lower ports 342 and 343, respectively, permit circulation of down-hole well fluid within the annular region between the downward extension of the upper mandrel 324 and the combination of the piston 330 and the upward extension of the base mandrel 326. The pressure of the down-hole fluid thus communicated acts on the upper annular surface 330c of the piston 330 as well as the relatively smaller, lower annular surface 330d of the piston to generate a net downward force on the piston relative to the housing 318. Also, the free circulation of the down-hole fluid about the exterior of the piston 330 permits longitudinal movement of that element relative to the housing 318 while avoiding pressure locks that might otherwise result without such free fluid circulation.

The upward extension of the base mandrel 326 is equipped with a plurality of rectangular through-bores 326d permitting fluid pressure communication between the interior of the tubing string and the pressure chamber 322 within the mandrel assembly 318. A like number of dogs 353 are distributed throughout the plurality of through-bores 326d. The dogs 353 are designed to be stopped by the base mandrel 326 to prevent the dogs from falling through the through-bores 326d to the interior of the housing 318. As an example of such design, each dog 353 may be in the form of a truncated wedge. The construction and design of such dogs are well known in the field, and will not be described in further detail herein.

A restraining ring 345 generally rides within a radially outwardly extending annular recess 330e in the piston 330. When positioned laterally in line with the dogs 353, the restraining ring 345 confines the dogs to radially inward locations relative to the base mandrel 326. When the piston 330 is lowered, a radially inwardly extending annular shoulder 330f, marking the upward extension of the recess 330e, engages the top of the restraining ring 345 and moves the latter element downwardly. With the restraining ring 345 moved out of lateral alignment with the dogs 353 as indicated in FIG. 12, the dogs are free to be moved radially outwardly until they engage the piston 330.

The sealing device at 320 includes a generally annular seat member 354 equipped with a beveled, annular seating surface 354a. Also, the seat member 354 includes, about its radially outward surface, a radially-inwardly extending annular recess 354b featuring beveled walls. The annular recess 354b receives the plurality of dogs 353 when the latter are confined to the radially inward locations by the restraining ring 345. Thus, the dogs 353 cooperate with the annular recess 354b to maintain the seat member 354 anchored relative to the housing 318. Further, the restraining ring 345 acts on the dogs 353 to lock the latter elements in such anchoring configuration. An O-ring 356, carried within an appropriate annular groove in the outer surface of the seat member 354, fluid-seals the seat member to the interior surface of the base mandrel 326. A ball valve 358 may be received by the seating surface 354*a* as indicated in FIG. 11 to thereby cooperate with the O-ring seal 356 to fluid-seal the interior of the tubing string and the plugging apparatus 310 from fluid communication below the sealing device 320.

With the plugging apparatus 310 in position within a well, supported by a tubing string and well tool to be set or otherwise operated by hydraulic pressure, the ball valve 358 may be dropped down the well to be received by the annular seat member 354 to fluid-seal the interior of the tubing string and related tools as indicated in FIG. 11. Then, as the hydraulic pressure within the tubing string increases, this hydraulic pressure increase is communicated to the pressure chamber 322 through the through-bores 326*d*. The dogs 353 are fitted sufficiently loosely within their respective through-bores 326*d* to permit such fluid communication, as well as to permit limited radial movement of the dogs relative to the upward extension of the base mandrel 326. As the fluid pressure within the pressure chamber 322 increases, the piston 330 is urged upwardly, causing the shear pin 336 to break. As the piston 330 is then driven upwardly by the net force thereon, the spring 340 is further compressed. An inwardly-extending shoulder 324*b* on the upper mandrel 324 receives the upper piston surface 330*c* to limit the upward movement of the piston.

The restraining ring 345 fits sufficiently loosely within the annular recess 330*e* to permit relative movement between the driven piston 330 and the restraining ring. However, frictional forces acting between the dogs 353 and the ring 345 maintain the ring in lateral alignment with the dogs 353 to confine the latter elements locked in the radial positions indicated in FIG. 11 to maintain anchoring engagement with the plug device 320.

Once the hydraulic pressure within the tubing string has been sufficiently increased to set, or otherwise operate, the tool suspended thereby, the fluid pressure within the tubing string may be decreased, allowing the spring 340 and the net external fluid pressure acting on the surfaces 330*c* and 330*d* of the piston 330 to move the piston downwardly relative to the housing 318. With the shear pin 336 no longer intact, the piston is free to be moved beyond its original position indicated in FIG. 11, thereby forcing the restraining ring 345 downwardly relative to the dogs 353. A beveled snap ring 361 is carried in an appropriate annular groove in the upward extension of the base mandrel 326 to facilitate the downward movement of the restraining ring 345. The snap ring 361 prevents the inadvertent downward movement of the restraining ring 345 until the latter is so propelled downwardly by the action of the piston 330. Once the annular shoulder 330*f* of the piston 330 propels the restraining ring 345 out of engagement with the dogs 353, the dogs are relatively free to be urged radially outwardly by the beveled wall of the annular recess 354*b* in the seat member 354. Thus, under the weight of the ball valve 358 and the seat member 354, or under the influence of fluid pumping from the surface acting on the sealing device 320, the sealing device is able to be moved downwardly free of the dogs 353, and clear of the housing 318 as indicated in FIG. 12. The snap ring 361 then prevents the restraining ring 345 from inadvertently relocating in transverse alignment with the dogs 353, since such alignment would project the dogs into the interior of the housing 318 to restrict passage therethrough.

Thus, as in the previously described embodiments, the no-shock pressure plug indicated at 310 in FIGS. 11 and 12 provides a plugging apparatus which features a spring 340 whose characteristics may be altered to provide for the unplugging of the tubing string when the pressure therein has been sufficiently reduced to avoid substantial pressure differentials being relieved upon such unplugging to cause damaging pressure waves.

The floating seal plug shown at 16 in FIGS. 1 and 3 may be employed with any of the previously described embodiments of the no-shock pressure plug, particularly in situations where the down-hole pressure in the well is substantially large. In such circumstances, the valve member, such as the ball valves 158 and 358, or the plug element 259, might otherwise be forced upwardly out of their respective sealing configurations by the large down-hole pressure. In such case, the floating seal plug provides what may be described as a temporary, secondary seal against such pressure, thus isolating the valve members of the no-shock pressure plug until such time as the latter elements are to be intentionally freed from their sealing configurations.

The floating seal plug 16 includes a housing 400, which may be an extension of the tubing string element 14' joining the floating seal plug to the plugging apparatus 10. The housing 400 includes an enlarged chamber 400*a* whose upper limit is marked by an inwardly extending, annular shoulder 400*b*, and which is generally open to the bottom of the well, but which is partially obstructed by a retainer ring 401 locked against longitudinal movement relative to the housing by frangible shear pins 402. A seal element 403 is also locked in position within the chamber 400*a* by frangible shear pins 404. An O-ring 405 is carried, in an appropriate annular groove, by the seal element 403 to fluid-seat the latter to the interior surface of the housing 400 within the chamber 400*a*.

The well packer 12, or other appropriate well tools, is lowered with the floating seal plug 16 and no-shock pressure plug 10 on the tubing string 14 with fluid contained within the tubing string segment 14'. One method of effecting such a process is to place the fluid within the tubing string segment 14' followed by the seating of a ball valve, 158 or 358 as appropriate, or the positioning of the plug element 259 in sealing engagement with its corresponding housing, depending on the embodiment of the plugging apparatus used, after positioning of the floating seal plug 16 at the end of the segment 14'. Thus a column of fluid may be confined within the tubing string segment 14' between the plugging apparatus at 10 and the floating seal plug at 16. Then, as the tubing string with its related equipment is lowered into the well, the fluid already within the tubing string 14' and the seal element 403 operate to diminish the pressure differential experienced by the seal device of the plugging apparatus.

The shear pins 404 are sufficiently weak to shear upon any substantial pressure differential across the seal element 403, allowing the seal element to be raised under the influence of the large down-hole fluid pressure until the seal element engages the inwardly extending shoulder 400*b*. Then, the net force acting upwardly on the seal element 403 due to the pressure differential across that body is communicated to the tubing string segment 14', and sustained, in part, by the weight of the tubing string 14 and its attached equipment.

After the well packer 12, or other tool, is appropriately set or operated on by increased hydraulic pressure within the tubing string 14, and the pressure therein is reduced to permit the freeing of the sealing device within the plugging apparatus at 10, hydraulic pressure within the tubing string 14 may again be increased by pumping at the surface. Such increase in hydraulic pressure is communicated to the floating seal plug at 16, causing the seal element 403 to bear downwardly against the retainer ring 401, with the result that the shear pins 402 are broken. Then, the seal element 403, the ring 401, and the sealing device from the plugging apparatus at 10 may be pumped out of the tubing string segment 14' through the housing 400, leaving the entire tubing string clear for production of the well, or other operation.

Before the last increase in hydraulic pressure within the tubing string 14 is applied to shear the pins 402, the tubing string 14 may be replaced with another type string, such as one specifically for use as a production string.

It will be appreciated that the no-shock pressure plug of the present invention provides apparatus whereby a tubing string may be selectively fluid-sealed to permit increased hydraulic pressure therein for any purpose, such as setting a well packer or operating some other tool. Prior to, and during such increase in hydraulic pressure, the sealing of the tubing string is effected by way of a sealing device of the plugging apparatus, wherein the sealing device is anchored in place by the positive locking of dogs or lugs, with no reliance for such anchoring on either friction or hydraulic pressure itself. Locking means, such as frangible shear pins, are used to permit the anchoring means to be restrained in anchoring configuration to maintain the sealing device in sealing configuration. Once such locking means are released, that is, for example, the pins are broken by the increase in hydraulic pressure, the hydraulic pressure itself then drives a piston to compress and hold a restorative device, such as a coil spring, which later supplies energy to release the anchoring of the sealing device.

While several embodiments of the no-shock pressure plug of the present invention have been described in detail herein, it will be appreciated that variations may be effected in the construction and design of the plugging apparatus without departing from the scope of the invention. Thus, for example, other types of restorative devices may be employed in place of the coil springs to store energy to release the sealing device. Such restorative devices may include fluid pressure piston-and-cylinder assemblies located within the housing of the plugging apparatus where the coils are indicated in the figures.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. Releasable closure apparatus, for selectively closing a passage, comprising:

(a) generally tubular housing means, including a passage therethrough and pressure chamber means for receiving fluid pressure from said passage;

(b) seal means for selectively closing said passage when said seal means is in sealing configuration;

(c) releasable anchoring means, moveable between an anchoring configuration for maintaining said seal means in said sealing configuration, and a release configuration for releasing said seal means to move out of said sealing configuration;

(d) piston means moveable in a first direction relative to said housing means, propelled by fluid pressure so received by said pressure chamber means, and moveable in a second direction generally opposite said first direction, propelled by spring means;

(e) restraining means for selectively confining said anchoring means in said anchoring configuration, and moveable, by said piston means operating thereon when so moved in said second direction, to release said anchoring means to move out of said anchoring configuration to said release configuration; and (f) releasable lock means for preventing motion of said piston means relative to said housing means, which lock means may be released by fluid pressure being received by said pressure chamber means to propel said piston means in said first direction whereby said piston means is then released to be so moved in said second direction to so operate on said restraining means to thereby permit said anchoring means to release said seal means.

2. Apparatus as defined in claim 1 wherein said lock means comprises pin means which is released by being broken when said piston means moves in said first direction.

3. Apparatus as defined in claim 1 wherein said seal means comprises seat means selectively engageable by said anchoring means, whereupon said seat means is fluid-sealed to said housing means, and ball valve means selectively positionable relative to said seat means for effecting said sealing configuration.

4. Apparatus as defined in claim 1 wherein said seal means comprises a generally cylindrical plug element selectively engageable by said anchoring means, whereupon said plug element is fluid-sealed to said housing means to effect said sealing configuration.

5. Apparatus as defined in claim 1 wherein said anchoring means comprises lug means, and said restraining means comprises collet means on which are mounted said lug means such that said collet means bias said lug means to extend radially inwardly to effect said anchoring configuration, and said piston means, moving in said second direction, engages said collet means to propel said collet means to move said lug means generally radially outwardly out of said anchoring configuration.

6. Apparatus as defined in claim 5 wherein said seal means comprises seat means selectively engageable by said anchoring means, whereupon said seat means is fluid-sealed to said housing means, and ball valve means selectively positionable relative to said seat means for effecting said sealing configuration.

7. Apparatus as defined in claim 1 wherein said anchoring means comprises dog means moveable generally radially between said anchoring configuration and said release configuration, and wherein said restraining means includes generally annular surface means for selectively engaging said dog means for limiting the radial movement of said dog means to so confine said dog means in said anchoring configuration, said surface means being moveable longitudinally out of said engagement by said piston means operating thereon to so release said anchoring means.

8. Apparatus as defined in claim 7 wherein said seal means comprises seat means selectively engageable by said anchoring means, whereupon said seat means is fluid-sealed to said housing means, and ball valve means selectively positionable relative to said seat means for effecting said sealing configuration.

9. Apparatus as defined in claim 7 wherein said seal means comprises a generally cylindrical plug element selectively engageable by said anchoring means, whereupon said plug element is fluid-sealed to said housing means to effect said sealing configuration.

10. Apparatus as defined in claim 7 wherein said dog means are supported on collet means.

* * * * *